US011263946B2

(12) United States Patent
Peng et al.

(10) Patent No.: US 11,263,946 B2
(45) Date of Patent: Mar. 1, 2022

(54) REFERENCE VOLTAGE GENERATING CIRCUIT AND DISPLAY DEVICE

(71) Applicants: HKC CORPORATION LIMITED, Shenzhen (CN); CHONGQING HKC OPTOELECTRONICS TECHNOLOGY CO., LTD., Chongqing (CN)

(72) Inventors: Gege Peng, Shenzhen (CN); Xiaoyu Huang, Shenzhen (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/327,430

(22) Filed: May 21, 2021

(65) Prior Publication Data

US 2021/0280116 A1 Sep. 9, 2021

Related U.S. Application Data

(63) Continuation of application No. PCT/CN2020/093307, filed on May 29, 2020.

(30) Foreign Application Priority Data

Jun. 10, 2019 (CN) ..... 201910498972.0

(51) Int. Cl.
*G09G 3/20* (2006.01)
*G05F 3/24* (2006.01)

(52) U.S. Cl.
CPC ..... *G09G 3/20* (2013.01); *G05F 3/24* (2013.01); *G09G 2300/0828* (2013.01);
(Continued)

(58) Field of Classification Search
CPC ..... G09G 2310/027; G09G 2310/0291; G09G 2310/0275; G09G 2310/0243; G09G 2310/0272
See application file for complete search history.

(56) References Cited

U.S. PATENT DOCUMENTS 6,781,532 B2 8/2004 Wei
2006/0077738 A1* 4/2006 Kwon ..... G09G 3/3283 365/203

(Continued)

FOREIGN PATENT DOCUMENTS

CN 1670801 A 9/2005
CN 100442339 C 12/2008

(Continued)

OTHER PUBLICATIONS

First Office Action issued in counterpart Chinese Patent Application No. 201910498972.0, dated Dec. 17, 2020.

(Continued)

*Primary Examiner* — Gerald Johnson
(74) *Attorney, Agent, or Firm* — Westbridge IP LLC

(57) ABSTRACT

Disclosed are a reference voltage generating circuit and a display device. The reference voltage generating circuit includes a timing control circuit, a digital-to-analog conversion circuit, an operational amplifier circuit, a drive circuit, a switch control circuit, a first switch circuit, and a second switch circuit. The switch control circuit generates a control signal according to a frame start signal and a clock signal provided by the timing control circuit, and outputs the control signal to the first switch circuit and the second switch circuit to control the channels inside the first switch circuit and the second switch circuit to be turned on sequentially, such that an analog voltage signal output by the digital-to-analog conversion circuit can be output to the drive circuit through the first switch circuit, the operational amplifier
(Continued)

circuit and the second switch circuit, to provide a reference voltage signal for the drive circuit.

19 Claims, 3 Drawing Sheets

(52) U.S. Cl.
CPC . *G09G 2310/0291* (2013.01); *G09G 2310/06* (2013.01); *G09G 2320/0673* (2013.01)

(56) References Cited

U.S. PATENT DOCUMENTS

| | | | | |
|---|---|---|---|---|
| 2006/0139263 | A1* | 6/2006 | Choi | G09G 3/3283 345/76 |
| 2007/0229439 | A1 | 10/2007 | Wang et al. | |
| 2008/0291190 | A1 | 11/2008 | Kim et al. | |
| 2009/0289964 | A1* | 11/2009 | Miyachi | G09G 3/3648 345/690 |
| 2020/0193905 | A1* | 6/2020 | Yoon | G09G 3/3233 |
| 2021/0201733 | A1* | 7/2021 | Lee | G09G 3/20 |

FOREIGN PATENT DOCUMENTS

| | | | |
|---|---|---|---|
| CN | 101339754 | A | 1/2009 |
| CN | 101727850 | A | 6/2010 |
| CN | 101847378 | A | 9/2010 |
| CN | 105609064 | A | 5/2016 |
| CN | 109509420 | A | 3/2019 |
| CN | 109671406 | A | 4/2019 |
| CN | 110379383 | A | 10/2019 |

OTHER PUBLICATIONS

International Search Report and Written Opinion issued in corresponding PCT Application No. PCT/CN2020/093307, dated Aug. 21, 2020.

* cited by examiner

REFERENCE VOLTAGE GENERATING CIRCUIT AND DISPLAY DEVICE

CROSS-REFERENCE TO RELATED APPLICATIONS

This application is a Continuation Application of International Application No. PCT/CN2020/093307, filed on May 29, 2020, which claims priority to Chinese Application No. 201910498972.0, filed on Jun. 10, 2019, filed with China National Intellectual Property Administration, and entitled "REFERENCE VOLTAGE GENERATING CIRCUIT AND DISPLAY DEVICE", the entire disclosure of which is incorporated herein by reference.

TECHNICAL FIELD

The present disclosure relates to the technical field of display, and in particular to a reference voltage generating circuit and a display device.

BACKGROUND

In display devices, after the voltage signal and control signal output by the system main board are processed by the timing control circuit, they are output to the display panel through the source drive circuit and the gate drive circuit, so that the display device can display normally.

In order to make the voltage signal output by the source drive circuit conform to the user's viewing habits, it is necessary to provide a reference voltage signal for the source drive circuit, which can be generated by a gamma voltage chip. The output of each voltage signal inside the gamma voltage chip needs to be converted by a digital-to-analog converter, and then the operational amplifier outputs the voltage signal converted by the digital-to-analog converter to the source drive circuit. Since the number of output channels in the gamma voltage chip corresponds to the number of operational amplifiers, the number of operational amplifiers is too large, and the complexity of the internal circuit of the gamma voltage chip will increase and the cost will increase.

SUMMARY

The present disclosure provides a reference voltage generating circuit and a display device, aiming to simplify the internal circuit structure of the gamma chip and reduce the cost of the gamma chip.

In order to achieve the above objective, the present disclosure provides a reference voltage generating circuit, including:

a timing control circuit;

a digital-to-analog conversion circuit being provided with n voltage signal output terminals, and for providing an analog voltage signal;

an operational amplifier circuit;

a drive circuit;

a switch control circuit being provided with a first signal input terminal, n second signal input terminals, n first signal output terminals and n second signal output terminals, wherein the first signal input terminal of the switch control circuit is connected to a frame signal output terminal of the timing control circuit, the n second signal input terminals of the switch control circuit are all connected to a clock signal output terminal of the timing control circuit; upon receiving a frame start signal output by the frame signal output terminal of the timing control circuit, and receiving a clock signal output by the clock signal output terminal of the timing control circuit, the switch control circuit is for outputting a high-level control signal from one of the n first signal output terminals, and outputting a low-level control signal from one of the n second signal output terminals;

a first switch circuit being provided with n first input terminals, n first controlled terminals and n first output terminals, wherein the n first input terminals of the first switch circuit are connected to the n voltage signal output terminals of the digital-to-analog conversion circuit in a one-to-one correspondence, the n first controlled terminals of the first switch circuit are connected to the n first signal output terminals of the switch control circuit in a one-to-one correspondence, the n first output terminals of the first switch circuit are all connected to an input terminal of the operational amplifier circuit; upon receiving the analog voltage signal output by the digital-to-analog conversion circuit, and receiving the high-level control signal output by the switch control circuit, the first switch circuit is for outputting the analog voltage signal from one of the n first output terminals to the operational amplifier circuit; and a second switch circuit being provided with n second input terminals, n second controlled terminals and n second output terminals, wherein the n second input terminals of the second switch circuit are all connected to an output terminal of the operational amplifier circuit, the n second controlled terminals of the second switch circuit are connected to the n second signal output terminals of the switch control circuit in a one-to-one correspondence, the n second output terminals of the second switch circuit are all connected to the input terminal of the drive circuit; upon receiving the analog voltage signal transmitted by the operational amplifier circuit, and receiving the low-level control signal output by the switch control circuit, the second switch circuit is for outputting the analog voltage signal from one of the second output terminals of the n second output terminals to the drive circuit, n is an integer greater than or equal to 1.

In order to achieve the above objective, the present disclosure further provides a reference voltage generating circuit, including:

a timing control circuit;

a memory for providing a digital voltage signal;

a digital-to-analog conversion circuit being provided with n voltage signal input terminals and n voltage signal output terminals, wherein the n voltage signal input terminals of the digital-to-analog conversion circuit are all connected to a signal transmission terminal of the memory, the digital-to-analog conversion circuit is for receiving the digital voltage signal output by the memory, converting the digital voltage signal into an analog voltage signal, and outputting the analog voltage signal;

an operational amplifier circuit;

a drive circuit;

a switch control circuit being provided with a first signal input terminal, n second signal input terminals, n first signal output terminals and n second signal output terminals, wherein the first signal input terminal of the switch control circuit is connected to a frame signal output terminal of the timing control circuit, the n second signal input terminals of the switch control circuit are all connected to a clock signal output terminal of the timing control circuit; upon receiving a frame start signal output by the frame signal output terminal of the timing control circuit, and receiving a clock signal output by the clock signal output terminal of the timing control circuit, the switch control circuit is for outputting a high-level control signal from one of the n first signal output terminals, and outputting a low-level control signal from one of the n second signal output terminals;

a first switch circuit being provided with n first input terminals, n first controlled terminals and n first output terminals, wherein the n first input terminals of the first switch circuit are connected to the n voltage signal output terminals of the digital-to-analog conversion circuit in a one-to-one correspondence, the n first controlled terminals of the first switch circuit are connected to the n first signal output terminals of the switch control circuit in a one-to-one correspondence, the n first output terminals of the first switch circuit are all connected to an input terminal of the operational amplifier circuit; upon receiving the analog voltage signal output by the digital-to-analog conversion circuit, and receiving the high-level control signal output by the switch control circuit, the first switch circuit is for outputting the analog voltage signal from one of the n first output terminals to the operational amplifier circuit; and a second switch circuit being provided with n second input terminals, n second controlled terminals and n second output terminals, wherein the n second input terminals of the second switch circuit are all connected to an output terminal of the operational amplifier circuit, the n second controlled terminals of the second switch circuit are connected to the n second signal output terminals of the switch control circuit in a one-to-one correspondence, the n second output terminals of the second switch circuit are all connected to the input terminal of the drive circuit; upon receiving the analog voltage signal transmitted by the operational amplifier circuit, and receiving the low-level control signal output by the switch control circuit, the second switch circuit is for outputting the analog voltage signal from one of the second output terminals of the n second output terminals to the drive circuit, n is an integer greater than or equal to 1.

In order to achieve the above objective, the present disclosure further provides a display device. The display device includes the reference voltage generating circuit as described above and a display panel, and a drive circuit of the reference voltage generating circuit is connected to the display panel.

In technical solutions of the present disclosure, the switch control circuit generates corresponding control signals according to the frame start signal and the clock signal provided by the timing control circuit and outputs them to the first switch circuit and the second switch circuit, to control the channels in the first switch circuit and the second switch circuit to be turned on sequentially, such that the analog voltage signal output by the digital-to-analog conversion circuit can be output to the drive circuit through the first switch circuit, the operational amplifier circuit and the second switch circuit, so as to provide a reference voltage signal for the drive circuit. By reducing the number of operational amplifier circuits, the internal circuit structure of the gamma chip is simplified and the cost of the gamma chip is reduced.

BRIEF DESCRIPTION OF THE DRAWINGS

In order to more clearly illustrate the embodiments of the present disclosure, drawings used in the embodiments will be briefly described below. Obviously, the drawings in the following description are only some embodiments of the present disclosure. It will be apparent to those skilled in the art that other figures can be obtained according to the structures shown in the drawings without creative work.

Figure 1:
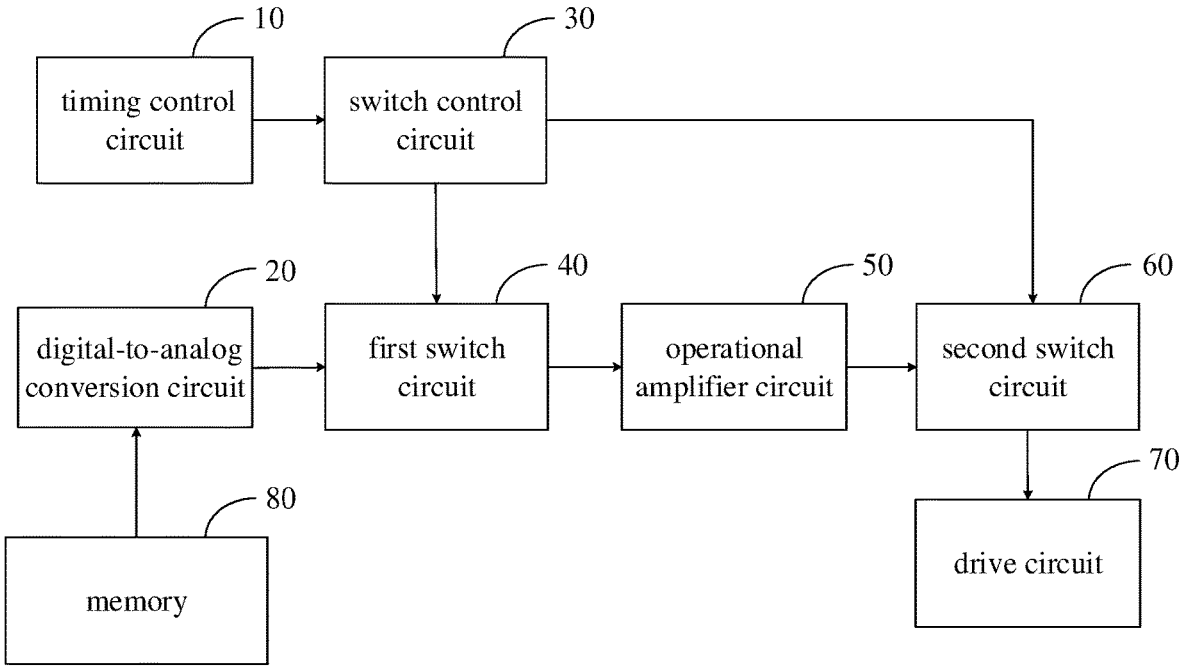
FIG. 1 is a block diagram of a reference voltage generating circuit according to an embodiment of the present disclosure.

The realization of the objective, functional characteristics, and advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

Besides, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

The present disclosure provides a reference voltage generating circuit.

As shown in FIG. 1, the reference voltage generating circuit includes a timing control circuit 10, a digital-to-analog conversion circuit 20, an operational amplifier circuit 50, a switch control circuit 30, a first switch circuit 40, a second switch circuit 60, and a drive circuit 70. A first signal input terminal of the switch control circuit 30 is connected to a frame signal output terminal of the timing control circuit 10. N second signal input terminals of the switch control circuit 30 are all connected to a clock signal output terminal of the timing control circuit 10. N first signal output terminals of the switch control circuit 30 are connected to n first controlled terminals of the first switch circuit 40 in a one-to-one correspondence. The n second signal output terminals of the switch control circuit 30 are connected to n second controlled terminals of the second switch circuit 60 in a one-to-one correspondence. The n first input terminals of the first switch circuit 40 are connected to n voltage signal output terminals of the digital-to-analog conversion circuit 20 in a one-to-one correspondence. The n first output terminals of the first switch circuit 40 are all connected to an input terminal of the operational amplifier circuit 50. The n second input terminals of the second switch circuit 60 are all connected to an output terminal of the operational amplifier circuit 50. The n second output terminals of the second switch circuit 60 are all connected to an input terminal of the drive circuit 70, n is an integer greater than or equal to 1.

In this embodiment, the timing control circuit 10 can optionally be a timing controller, and the timing control circuit 10 can provide a frame start signal and a clock signal for the switch control circuit 30.

The digital-to-analog conversion circuit 20 can convert a digital voltage signal into an analog voltage signal, and the digital-to-analog conversion circuit 20 can be composed of multiple digital-to-analog converters.

The switch control circuit 30 is to, when receiving a frame start signal output by the frame signal output terminal of the timing control circuit 10, and receiving a clock signal output by the clock signal output terminal of the timing control circuit 10, output a high-level control signal through one of the n first signal output terminals, and outputs a low-level control signal through one of the n second signal output terminals.

The first switch circuit 40 can be implemented by a circuit composed of various transistors, such as an insulating field effect tube, a triode, etc., which is not limited here.

The second switch circuit 60 can be implemented by a circuit composed of various transistors, such as an insulating field effect transistor, a triode, etc., which is not limited here.

In technical solutions of the present disclosure, the reference voltage generating circuit can be provided inside the gamma chip. In order to better illustrate the technical concept of the present disclosure, the n first signal output terminals of the switch control circuit 30 are denoted by reference signs A1 to An, respectively. The n second signal output terminals of the switch control circuit 30 are denoted by reference signs B1 to Bn, respectively. The n first input terminals of the first switch circuit 40 are denoted by reference signs E1 to En, respectively. The n first controlled terminals of the first switch circuit 40 are denoted by reference signs G1 to Gn, respectively. The n first output terminals of the first switch circuit 40 are denoted by reference signs F1 to Fn, respectively. The n second input terminals of the second switch circuit 60 are denoted by reference signs H1 to Hn, respectively. The n second controlled terminals of the second switch circuit 60 are denoted by reference signs J1 to Jn. The n second output terminals of the second switch circuit 60 are denoted by reference signs K1 to Kn, respectively.

Specially, when the system is started, the frame signal output terminal of the timing control circuit 10 outputs a high-level frame start signal to the first signal input terminal of the switch control circuit 30. When the clock signal output terminal of the timing control circuit 10 outputs the first clock signal to the n second signal input terminals of the switch control circuit 30, the A1 terminal of the switch control circuit 30 outputs a high-level control signal to the G1 terminal of the first switch circuit 40, so that the channel between the E1 terminal and the F1 terminal is turned on. The other n−1 first signal output terminals of the switch control circuit 30 output low-level control signals to the other n−1 first controlled terminals of the first switch circuit 40. At the same time, the B1 terminal of the switch control circuit 30 outputs a low-level control signal to the J1 terminal of the second switch circuit 60 to control the conduction of the channel between the H1 terminal and the K1 terminal of the second switch circuit 60. The other n−1 second signal output terminals of the switch control circuit 30 output high-level control signals to the other n−1 second controlled terminals of the second switch circuit 60. After the digital-to-analog conversion circuit 20 reads a digital voltage signal from the memory 80 and converts the digital voltage signal into an analog voltage signal, the analog voltage signal is output to the drive circuit 70 through the channel between the E1 terminal and the F1 terminal of the first switch circuit 40, the operational amplifier circuit 50, and the channel between the H1 terminal and the K1 terminal of the second switch circuit 60, to provide a reference voltage signal for the drive circuit 70. The operational amplifier circuit may be an operational amplifier OP, which can amplify current signals in the system and output the amplified current signals, so as to improve the drive capability of the system and enable the load to work normally.

The reference voltage generating circuit also includes n stabilizing capacitors, and one terminal of each of the n stabilizing capacitors is connected to one of the n second output terminals of the second switch circuit 60 in a one-to-one correspondence. Therefore, when any second output terminal of the second switch circuit 60 outputs an analog voltage signal, the stabilizing capacitor connected to the second output terminal that outputs the analog voltage signal is charged. The drive circuit 70 may be a source drive circuit.

Further, when the timing control circuit 10 outputs the second clock signal, it pulls the frame start signal low. At this time, the A2 terminal of the switch control circuit 30 outputs a high-level control signal to the G2 terminal of the first switch circuit 40, so that the channel between the E2 terminal and the F2 terminal is turned on. The other n−1 first signal output terminals of the switch control circuit 30 all output low-level control signals to the other n−1 first controlled terminals of the first switch circuit 40. At the same time, the B2 terminal of the switch control circuit 30 outputs a low-level control signal to the J2 terminal of the second switch circuit 60 to control the conduction of the channel between the H2 terminal and the K2 terminal of the second switch circuit 60. The other n−1 second signal output terminals of the switch control circuit 30 all output high-level control signals to the other n−1 second controlled terminals of the second switch circuit 60. At this time, after the digital-to-analog conversion circuit 20 reads a digital voltage signal from the memory 80 and converts the digital voltage signal into an analog voltage signal, the analog voltage signal is output to the drive circuit 70 through the channel between the E2 terminal and the F2 terminal of the first switch circuit 40, the operational amplifier circuit 50, and the channel between the H2 terminal and the K2 terminal of the second switch circuit 60, to provide a reference voltage signal for the drive circuit 70. Besides, when the timing control circuit 10 outputs the second clock signal, although the channel between the E1 terminal and the F1 terminal of the first switch circuit 40 is turned off, the channel between the H1 terminal and the K1 terminal of the second switch circuit 60 is also turned off. However, since each second output terminal of the second switch circuit 60 is connected to a stabilizing capacitor, when the timing control circuit 10 outputs the second clock signal, the voltage stabilizing capacitor connected to the K1 terminal of the second switch circuit 60 starts to discharge, the K1 terminal of the second switch circuit 60 keeps outputting the analog voltage signal, and continues to provide the reference voltage signal for the drive circuit 70.

By analogy, when the timing control circuit 10 outputs the nth clock signal, the An terminal of the switch control circuit 30 outputs a high-level control signal to the Gn terminal of the first switch circuit 40, so that the channel between the En terminal and the Fn terminal is turned on. The other n−1 first signal output terminals of the switch control circuit 30 all output low-level control signals to the other n−1 first controlled terminals of the first switch circuit 40. The Bn terminal of the switch control circuit 30 outputs a low-level control signal to the Jn terminal of the second switch circuit 60 to control the conduction of the channel between the Hn terminal and the Kn terminal of the second switch circuit 60. The other n−1 second signal output terminals of the switch control circuit 30 all output high-level control signals to the other n−1 second controlled terminals of the second switch circuit 60. The analog voltage signal output by the digital-to-analog conversion circuit 20 is output to the drive circuit 70 through the channel between the En terminal and the Fn terminal of the first switch circuit 40, the operational amplifier circuit 50, and the channel between the Hn terminal and the Kn terminal of the second switch circuit 60, to provide a reference voltage signal for the drive circuit 70. Since each second output terminal of the second switch circuit 60 is connected to a stabilizing capacitor, when the timing control circuit 10 outputs the nth clock signal, the K1 terminal to Kn−1 terminal of the second switch circuit keep outputting the analog voltage signal, and continue to provide the reference voltage signal for the drive circuit 70, so that the system can work normally.

In technical solutions of the present disclosure, the switch control circuit 30 generates corresponding control signals according to the frame start signal and the clock signal provided by the timing control circuit 10 and outputs them to the first switch circuit 40 and the second switch circuit 60, to control the channels in the first switch circuit 40 and the second switch circuit 60 to be turned on sequentially, such that the analog voltage signal output by the digital-to-analog conversion circuit 20 can be output to the drive circuit 70 through the first switch circuit 40, the operational amplifier circuit 50 and the second switch circuit 60, so as to provide a reference voltage signal for the drive circuit 70. That is to say, in the reference voltage generating circuit of the present disclosure, only one operational amplifier circuit is provided to provide a reference voltage signal for the drive circuit 70. Such an arrangement can simplify the circuit structure inside the gamma chip and reduce the cost of the gamma chip.

Figure 2:
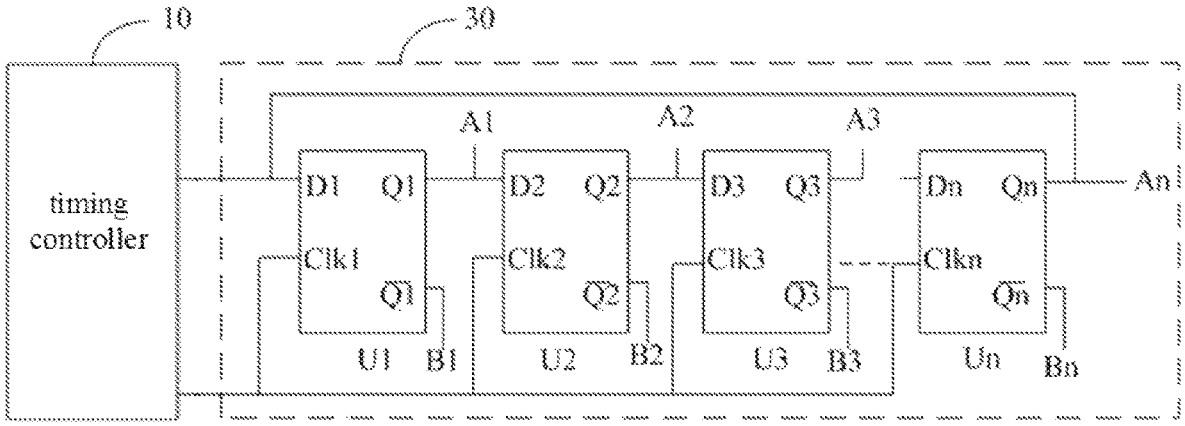
FIG. 2 is a schematic diagram of a switch control circuit in FIG. 1.

In an embodiment, as shown in FIG. 2, based on the above embodiment, the switch control circuit 30 includes n triggers connected in sequence, and the n triggers are denoted by reference signs U1 to Un. A clock signal input terminal Clk1 of the trigger U1 to the clock signal input terminal Clkn of the trigger Un are the n second signal input terminals of the switch control circuit 30. A first data output terminal Q1 of the trigger U1 to the first data output terminal Qn of the trigger Un are the n first signal output terminals of the switch control circuit 30. A second data output terminal $\overline{Q}$1 of the trigger U1 to the second data output terminal $\overline{Q}$n of the trigger Un are the n second signal output terminals of the switch control circuit 30. A data input terminal D1 of the trigger U1 located in a first position is the first signal input terminal of the switch control circuit 30, and is connected to the first data output terminal Qn of the trigger Un located in a last position. In two adjacent triggers, the first data output terminal of the trigger located in a previous position is connected to the data input terminal of the trigger located in a next position. For example, trigger U1 and trigger U2, trigger U2 and trigger U3, trigger U3 and trigger U4, etc. are respectively two adjacent triggers. That is, the first data output terminal Q1 of the trigger U1 is connected to the data input terminal D2 of the trigger U2, the first data output terminal Q2 of the trigger U2 is connected to the data input terminal D3 of the trigger U3, and so on. In this embodiment, these n triggers may be rising edge triggers. When the clock signal input terminal of the rising edge trigger receives a rising edge of a signal, the rising edge trigger assigns the logic level of the data input terminal to the first data output terminal, and outputs the inversion of the logic level at the second data output terminal.

Specially, when the system starts, the frame start signal output by the frame signal output terminal of the timing control circuit 10 is high. In the trigger U1 to the trigger Un, the data input terminal D1 of the trigger U1 receives the frame start signal output by the timing control circuit 10 is high, and the data input terminals of the trigger U2 to the trigger Un are low. When the clock signal output terminal of the timing control circuit 10 outputs the first clock signal, the trigger U1 assigns the high potential of the data input terminal D1 to the first data output terminal Q1. Therefore, the first data output terminal Q1 of the trigger U1 outputs a high-level control signal, and the second data output terminal $\overline{Q}$1 of the trigger U1 outputs a low-level control signal. Since the data input terminal D2 of the trigger U2 to the data input terminal Dn of the trigger Un are all low at this moment, the first data output terminal Q2 of the trigger U2 to the first data output terminal Qn of the trigger Un all output low-level control signals, while the second data output terminal $\overline{Q}$2 of the trigger U2 to the second data output terminal $\overline{Q}$n of the trigger Un all output high-level control signals. Since the first data output terminal of the trigger in the previous position is connected to the data input terminal of the trigger in the next position, when each clock signal arrives, the level value of the data input terminal of the trigger in the next position is equal to the level value of the first data output terminal of the trigger in the previous position. It can be understood that when the timing control circuit 10 outputs the second clock signal, the timing control circuit 10 pulls the frame start signal low at this time, and therefore, the data input terminal D1 of the trigger U1 is low. Since the data input terminal D2 of the trigger U2 is equal to the level value output by the first data output terminal Q1 of the trigger U1 when the first clock signal is applied, the data input terminal D2 of the trigger U2 is at a high level, and the data input terminal D3 of the trigger U3 to the data input terminal Dn of the trigger Un are at a low level. Thus, when the second clock signal comes, the first data output terminal Q2 of the trigger U2 outputs a high-level control signal, and the second data output terminal $\overline{Q}$2 of the trigger U2 outputs a low-level control signal, the first data output terminal Q1 of the trigger U1, the first data output terminal Q3 of the trigger U3 to the first data output terminal Qn of the trigger Un all output low-level control signals, the second data output terminal $\overline{Q}$1 of the trigger U1, the second data output terminal $\overline{Q}$3 of the trigger U3 and the second data output terminal $\overline{Q}$n of the trigger Un all output high-level control signals. By analogy, when the timing control circuit 10 outputs the nth clock signal, the first data output terminal Qn of the trigger Un outputs a high-level control signal, the second data output terminal $\overline{Q}$n of the trigger Un outputs a low-level control signal, the first data output terminal Q1 of the trigger U1 to the first data output terminal Qn−1 of the trigger Un−1 all output low-level control signals, the second data output terminal $\overline{Q}$1 of the trigger U1 to the second data output terminal $\overline{Q}$n−1 of the trigger Un−1 all output high-level control signals. That is, when any first signal output terminal of the switch control circuit 30 outputs a high-level control signal, the other n−1 first signal output terminals all output a low-level control signal. At the same time, when any second signal output terminal of the switch control circuit 30 outputs a low-level control signal, the other n−1 second signal output terminals all output a high-level control signal.

Figure 3:
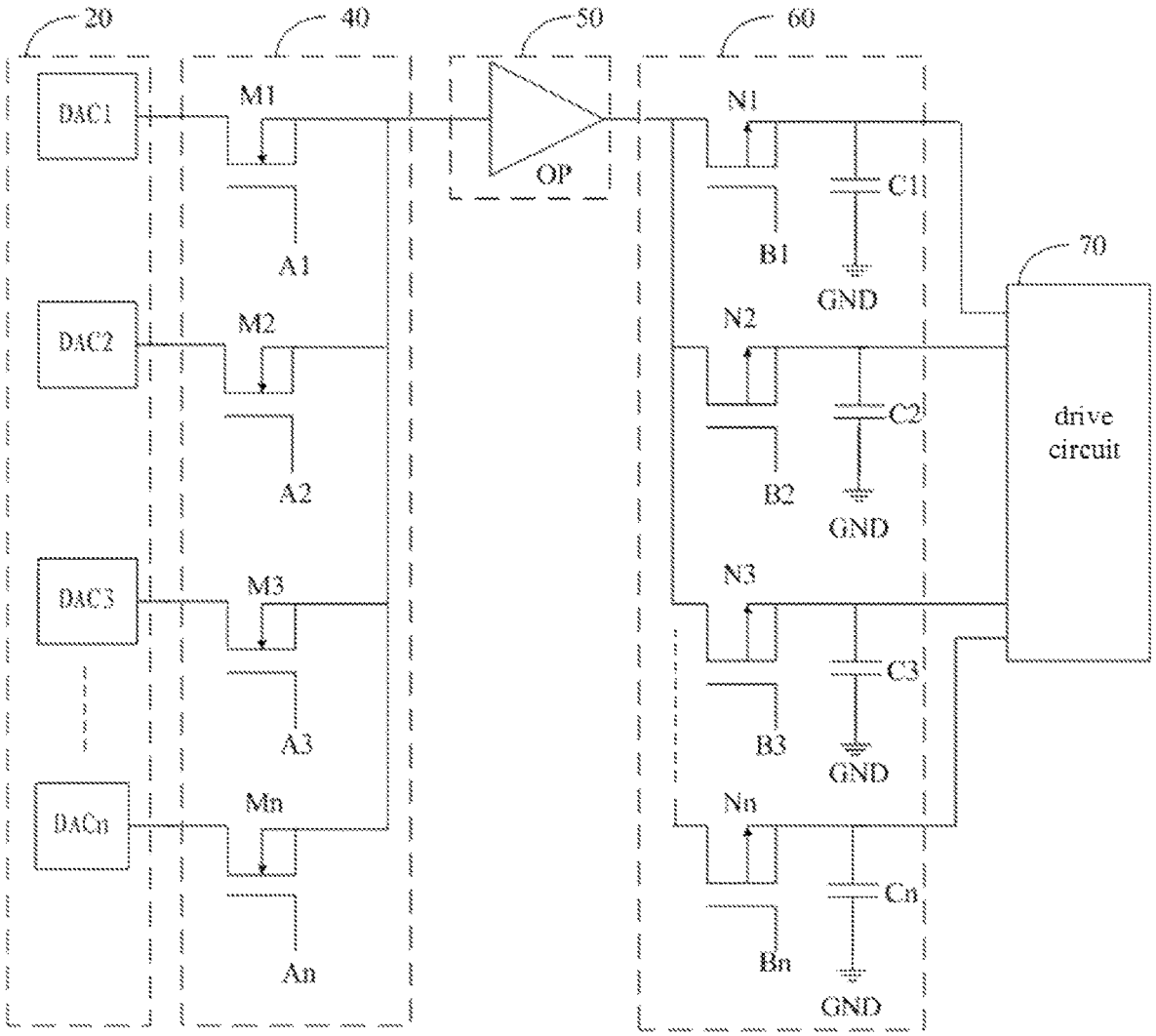
FIG. 3 is a schematic diagram of the reference voltage generating circuit according to an embodiment of the present disclosure.

In an embodiment, as shown in FIG. 3, based on the above embodiments, the first switch circuit 40 includes n first electronic switches. These n first electronic switches are denoted with reference signs M1 to Mn. Input terminals of M1 to Mn are the n first input terminals of the first switch circuit 40, controlled terminals of M1 to Mn are the n first controlled terminals of the first switch circuit 40, and output terminals of M1 to Mn are the n first output terminals of the first switch circuit 40. The n first electronic switches in this embodiment may be N-type insulating field effect transistors.

The working process of the first switch circuit 40 is: when the timing control circuit 10 outputs the first clock signal, the A1 terminal of the switch control circuit 30 outputs a high-level control signal, and the other n−1 first signal output terminals all output a low-level control signal. At this time, M1 is turned on, M2 to Mn are turned off, and the analog voltage signal output by the digital-to-analog conversion circuit 20 can be transmitted to the operational amplifier circuit 50 via M1. When the timing control circuit 10 outputs the second clock signal, the A2 terminal of the switch control circuit 30 outputs a high-level control signal, and the other n−1 first signal output terminals all output a low-level control signal. At this time, M2 is turned on, M1, and M3 to Mn are turned off, and the analog voltage signal output by the digital-to-analog conversion circuit 20 can be transmitted to the operational amplifier circuit 50 via M2. By analogy, when the timing control circuit 10 outputs the nth clock signal, the An terminal of the switch control circuit 30 outputs a high-level control signal, and the other n−1 first signal output terminals all output a low-level control signal. At this time, Mn is turned on, M1 to Mn−1 are turned off, and the analog voltage signal output by the digital-to-analog conversion circuit 20 can be transmitted to the operational amplifier circuit 50 via Mn.

In an embodiment, as shown in FIG. 3, based on the above embodiments, the second switch circuit 60 includes n second electronic switches. These n second electronic switches are denoted with reference signs N1 to Nn. Input terminals of N1 to Nn are the n second input terminals of the second switch circuit 60, controlled terminals of N1 to Nn are the n second controlled terminals of the second switch circuit 60, and output terminals of N1 to Nn are the n second output terminals of the second switch circuit 60. The n second electronic switches in this embodiment may be P-type insulating field effect transistors.

The working process of the second switch circuit 60 is: when the timing control circuit 10 outputs the first clock signal, the B1 terminal of the switch control circuit 30 outputs a low-level control signal, and the other n−1 second signal output terminals all output a high-level control signal. At this time, N1 is turned on, and N2 to Nn are turned off. The analog voltage signal transmitted by the operational amplifier circuit 50 can be transmitted to the drive circuit 70 through N1 to provide a reference voltage signal for the drive circuit 70. When the timing control circuit 10 outputs the second clock signal, B2 terminal of the switch control circuit 30 outputs a low-level control signal, and the other n−1 second signal output terminals all output a high-level control signal. At this time, N2 is turned on, N1, and N3 to Nn are turned off, and the analog voltage signal transmitted by the operational amplifier circuit 50 can be transmitted to the drive circuit 70 through N2 to provide a reference voltage signal for the drive circuit 70. By analogy, when the timing control circuit 10 outputs the nth clock signal, Bn terminal of the switch control circuit 30 outputs a low-level control signal, and the other n−1 second signal output terminals all output a low-level control signal. At this time, Nn is turned on, N1 to Nn−1 are turned off, and the analog voltage signal transmitted by the operational amplifier circuit 50 can be transmitted to the drive circuit 70 through Nn, and provides a reference voltage signal for the drive circuit 70.

The reference voltage generating circuit also includes n voltage stabilizing capacitors, denoted by reference signs C1 to Cn. One terminal of each of the n stabilizing capacitors is connected to one of the output terminals of the n second electronic switches, and the terminals of the n stabilizing capacitors are connected to the output terminals of the n second electronic switches in a one-to-one correspondence. The other terminals of the n stabilizing capacitors are all grounded. In other words, one terminal of C1 is connected to the output terminal of N1, the other terminal of C1 is grounded, one terminal of C2 is connected to the output terminal of N2, and the other terminal of C2 is grounded. By analogy, one terminal of Cn is connected to the output terminal of Nn, and the other terminal of Cn is grounded. Therefore, when the timing control circuit 10 outputs the first clock signal, N1 is turned on, N2 to Nn are all turned off, and the analog voltage signal output by the operational amplifier circuit 50 can be transmitted to the drive circuit 70 via N1. That is, the K1 terminal of the second switch circuit 60 outputs an analog voltage signal, and at this time, C1 starts to charge. When the timing control circuit 10 outputs the second clock signal, N2 is turned on, N1, N3 to Nn are all turned off, and the analog voltage signal output by the operational amplifier circuit 50 can be transmitted to the drive circuit 70 via N2. That is, the K2 terminal of the second switch circuit 60 outputs an analog voltage signal. At this time, C2 starts to charge, and when N1 is turned off, C1 starts to discharge. Therefore, the K1 terminal of the second switch circuit 60 keeps outputting the analog voltage signal. By analogy, when the timing control circuit 10 outputs the nth clock signal, Nn is turned on, N1 to Nn−1 are turned off, the Kn terminal of the second switch circuit 60 outputs the analog voltage signal, and Cn starts to charge. Due to the discharge effect of C1 to Cn−1, K1 terminal to Kn−1 terminal of the second switch circuit 60 keep outputting the analog voltage signal.

In an embodiment, as shown in FIG. 3, based on the above embodiments, the digital-to-analog conversion circuit 20 includes n digital-to-analog converters, and these n digital-to-analog converters are denoted by reference signs DAC1 to DACn. Output terminals of DAC1 to DACn are the n voltage signal output terminals of the digital-to-analog conversion circuit 20. Input terminals of DAC1 to DACn are the n voltage signal input terminals of the digital-to-analog conversion circuit 20, and the n voltage signal input terminals of the digital-to-analog conversion circuit 20 are all connected to the signal transmission terminal of the memory 80. Each digital-to-analog converter is to read the digital voltage signal stored in the memory 80, convert the digital voltage signal into an analog voltage signal, and output the analog voltage signal to the first switch circuit 40.

The present disclosure further provides a display device. The display device includes the reference voltage generating circuit as described above and a display panel, and the drive circuit of the reference voltage generating circuit is connected to the display panel. For the detailed structure of the reference voltage generating circuit, please refer to the above-mentioned embodiment, which will not be repeated here. It is understandable that since the above-mentioned reference voltage generating circuit is used in the display device of the present disclosure, the embodiments of the display device of the present disclosure include all the technical solutions of all the embodiments of the above-mentioned reference voltage generating circuit, and the technical effects achieved are also completely the same, which will not be repeated here.

In this embodiment, the display device may be a display device with a display panel such as a television, a tablet computer, a mobile phone, and the like. The display panel can be any of the following: liquid crystal display panel, OLED display panel, QLED display panel, Twisted Nematic (TN) or Super Twisted Nematic (STN) type, In-Plane Switching (IPS) type, Vertical Alignment (VA) type, curved panel, or other display panels.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A reference voltage generating circuit, comprising:

a timing control circuit;

a digital-to-analog conversion circuit, provided with n voltage signal output terminals, and for providing an analog voltage signal;

an operational amplifier circuit;

a drive circuit;

a switch control circuit, provided with a first signal input terminal, n second signal input terminals, n first signal output terminals and n second signal output terminals, wherein the first signal input terminal of the switch control circuit is connected to a frame signal output terminal of the timing control circuit, the n second signal input terminals of the switch control circuit are all connected to a clock signal output terminal of the timing control circuit; upon receiving a frame start signal output by the frame signal output terminal of the timing control circuit, and receiving a clock signal output by the clock signal output terminal of the timing control circuit, the switch control circuit is for outputting a high-level control signal from one of the n first signal output terminals, and outputting a low-level control signal from one of the n second signal output terminals;

a first switch circuit, provided with n first input terminals, n first controlled terminals and n first output terminals, wherein the n first input terminals of the first switch circuit are connected to the n voltage signal output terminals of the digital-to-analog conversion circuit in a one-to-one correspondence, the n first controlled terminals of the first switch circuit are connected to the n first signal output terminals of the switch control circuit in a one-to-one correspondence, the n first output terminals of the first switch circuit are all connected to an input terminal of the operational amplifier circuit; upon receiving the analog voltage signal output by the digital-to-analog conversion circuit, and receiving the high-level control signal output by the switch control circuit, the first switch circuit is for outputting the analog voltage signal from one of the n first output terminals to the operational amplifier circuit; and a second switch circuit, provided with n second input terminals, n second controlled terminals and n second output terminals, wherein the n second input terminals of the second switch circuit are all connected to an output terminal of the operational amplifier circuit, the n second controlled terminals of the second switch circuit are connected to the n second signal output terminals of the switch control circuit in a one-to-one correspondence, the n second output terminals of the second switch circuit are all connected to the input terminal of the drive circuit; upon receiving the analog voltage signal transmitted by the operational amplifier circuit, and receiving the low-level control signal output by the switch control circuit, the second switch circuit is for outputting the analog voltage signal from one of the second output terminals of the n second output terminals to the drive circuit, n is an integer greater than or equal to 1.

2. The reference voltage generating circuit of claim 1, wherein the switch control circuit includes n triggers connected in sequence, clock signal input terminals of the triggers are the second signal input terminals of the switch control circuit, first data output terminals of the trigger are the first signal output terminals of the switch control circuit, second data output terminals of the triggers are the second signal output terminals of the switch control circuit, a data input terminal of a trigger located in a first position is the first signal input terminal of the switch control circuit, and is connected to a first data output terminal of a trigger located in a last position; and in two adjacent triggers, a first data output terminal of a trigger located in a previous position is connected to a data input terminal of a trigger located in a next position.

3. The reference voltage generating circuit of claim 1, wherein when any first signal output terminal of the switch control circuit outputs a high-level control signal, other n−1 first signal output terminals all output a low-level control signal, and when any second signal output terminal of the switch control circuit outputs a low-level control signal, other n−1 second signal output terminals all output a high-level control signal.

4. The reference voltage generating circuit of claim 1, wherein the first switch circuit includes n first electronic switches, input terminals of the first electronic switches are the first input terminals of the first switch circuit, controlled terminals of the first electronic switches are the first controlled terminals of the first switch circuit, and output terminals of the first electronic switches are the first output terminals of the first switch circuit.

5. The reference voltage generating circuit of claim 1, wherein the second switch circuit includes n second electronic switches, input terminals of the second electronic switches are the second input terminals of the second switch circuit, controlled terminals of the second electronic switches are the second controlled terminals of the second switch circuit, and output terminals of the second electronic switches are the second output terminals of the second switch circuit.

6. The reference voltage generating circuit of claim 5, wherein the reference voltage generating circuit further includes n stabilizing capacitors, one terminal of each of the n stabilizing capacitors is connected to an output terminal of each of the n second electronic switches, and another terminal of each of the n stabilizing capacitors is grounded.

7. The reference voltage generating circuit of claim 6, wherein when the second electronic switch is turned on, a stabilizing capacitor connected to an output terminal of the turned-on second electronic switch is charged, and the output terminal of the second electronic switch outputs an analog voltage signal;

when the second electronic switch is switched from on state to off state, the stabilizing capacitor connected to the output terminal of the second electronic switch is discharged, and the output terminal of the second electronic switch keeps outputting the analog voltage signal.

8. The reference voltage generating circuit of claim 1, wherein the digital-to-analog conversion circuit includes n digital-to-analog converters, and output terminals of the digital-to-analog converters are the voltage signal output terminals of the digital-to-analog conversion circuit.

9. A reference voltage generating circuit, comprising:

a timing control circuit;

a memory for providing a digital voltage signal;

a digital-to-analog conversion circuit, provided with n voltage signal input terminals and n voltage signal output terminals, wherein the n voltage signal input terminals of the digital-to-analog conversion circuit are all connected to a signal transmission terminal of the memory, the digital-to-analog conversion circuit is for receiving the digital voltage signal output by the memory, converting the digital voltage signal into an analog voltage signal, and outputting the analog voltage signal;

an operational amplifier circuit;

a drive circuit;

a switch control circuit, provided with a first signal input terminal, n second signal input terminals, n first signal output terminals and n second signal output terminals, wherein the first signal input terminal of the switch control circuit is connected to a frame signal output terminal of the timing control circuit, the n second signal input terminals of the switch control circuit are all connected to a clock signal output terminal of the timing control circuit; upon receiving a frame start signal output by the frame signal output terminal of the timing control circuit, and receiving a clock signal output by the clock signal output terminal of the timing control circuit, the switch control circuit is for outputting a high-level control signal from one of the n first signal output terminals, and outputting a low-level control signal from one of the n second signal output terminals;

a first switch circuit, provided with n first input terminals, n first controlled terminals and n first output terminals, wherein the n first input terminals of the first switch circuit are connected to the n voltage signal output terminals of the digital-to-analog conversion circuit in a one-to-one correspondence, the n first controlled terminals of the first switch circuit are connected to the n first signal output terminals of the switch control circuit in a one-to-one correspondence, the n first output terminals of the first switch circuit are all connected to an input terminal of the operational amplifier circuit; upon receiving the analog voltage signal output by the digital-to-analog conversion circuit, and receiving the high-level control signal output by the switch control circuit, the first switch circuit is for outputting the analog voltage signal from one of the n first output terminals to the operational amplifier circuit; and a second switch circuit, provided with n second input terminals, n second controlled terminals and n second output terminals, wherein the n second input terminals of the second switch circuit are all connected to an output terminal of the operational amplifier circuit, the n second controlled terminals of the second switch circuit are connected to the n second signal output terminals of the switch control circuit in a one-to-one correspondence, the n second output terminals of the second switch circuit are all connected to the input terminal of the drive circuit; upon receiving the analog voltage signal transmitted by the operational amplifier circuit, and receiving the low-level control signal output by the switch control circuit, the second switch circuit is for outputting the analog voltage signal from one of the second output terminals of the n second output terminals to the drive circuit, n is an integer greater than or equal to 1.

10. The reference voltage generating circuit of claim 9, wherein the switch control circuit includes n triggers connected in sequence, clock signal input terminals of the triggers are the second signal input terminals of the switch control circuit, first data output terminals of the trigger are the first signal output terminals of the switch control circuit, second data output terminals of the triggers are the second signal output terminals of the switch control circuit, a data input terminal of a trigger located in a first position is the first signal input terminal of the switch control circuit, and is connected to a first data output terminal of a trigger located in a last position; and in two adjacent triggers, a first data output terminal of a trigger located in a previous position is connected to a data input terminal of a trigger located in a next position.

11. The reference voltage generating circuit of claim 9, wherein when any first signal output terminal of the switch control circuit outputs a high-level control signal, other n−1 first signal output terminals all output a low-level control signal, and when any second signal output terminal of the switch control circuit outputs a low-level control signal, other n−1 second signal output terminals all output a high-level control signal.

12. The reference voltage generating circuit of claim 9, wherein the first switch circuit includes n first electronic switches, input terminals of the first electronic switches are the first input terminals of the first switch circuit, controlled terminals of the first electronic switches are the first controlled terminals of the first switch circuit, and output terminals of the first electronic switches are the first output terminals of the first switch circuit.

13. A display device, comprising a reference voltage generating circuit and a display panel, a drive circuit of the reference voltage generating circuit being connected to the display panel, wherein the reference voltage generating circuit includes:

a timing control circuit;

a digital-to-analog conversion circuit, provided with n voltage signal output terminals, and for providing an analog voltage signal;

an operational amplifier circuit;

a drive circuit;

a switch control circuit, provided with a first signal input terminal, n second signal input terminals, n first signal output terminals and n second signal output terminals, wherein the first signal input terminal of the switch control circuit is connected to a frame signal output terminal of the timing control circuit, the n second signal input terminals of the switch control circuit are all connected to a clock signal output terminal of the timing control circuit; upon receiving a frame start signal output by the frame signal output terminal of the timing control circuit, and receiving a clock signal output by the clock signal output terminal of the timing control circuit, the switch control circuit is for outputting a high-level control signal from one of the n first signal output terminals, and outputting a low-level control signal from one of the n second signal output terminals;

a first switch circuit, provided with n first input terminals, n first controlled terminals and n first output terminals, wherein the n first input terminals of the first switch circuit are connected to the n voltage signal output terminals of the digital-to-analog conversion circuit in a one-to-one correspondence, the n first controlled terminals of the first switch circuit are connected to the n first signal output terminals of the switch control circuit in a one-to-one correspondence, the n first output terminals of the first switch circuit are all connected to an input terminal of the operational amplifier circuit; upon receiving the analog voltage signal output by the digital-to-analog conversion circuit, and receiving the high-level control signal output by the switch control circuit, the first switch circuit is for outputting the analog voltage signal from one of the n first output terminals to the operational amplifier circuit; and a second switch circuit, provided with n second input terminals, n second controlled terminals and n second output terminals, wherein the n second input terminals of the second switch circuit are all connected to an output terminal of the operational amplifier circuit, the n second controlled terminals of the second switch circuit are connected to the n second signal output terminals of the switch control circuit in a one-to-one correspondence, the n second output terminals of the second switch circuit are all connected to the input terminal of the drive circuit; upon receiving the analog voltage signal transmitted by the operational amplifier circuit, and receiving the low-level control signal output by the switch control circuit, the second switch circuit is for outputting the analog voltage signal from one of the second output terminals of the n second output terminals to the drive circuit, n is an integer greater than or equal to 1;

wherein the switch control circuit includes n triggers connected in sequence, clock signal input terminals of the triggers are the second signal input terminals of the switch control circuit, first data output terminals of the trigger are the first signal output terminals of the switch control circuit, second data output terminals of the triggers are the second signal output terminals of the switch control circuit, a data input terminal of a trigger located in a first position is the first signal input terminal of the switch control circuit, and is connected to a first data output terminal of a trigger located in a last position; and in two adjacent triggers, a first data output terminal of a trigger located in a previous position is connected to a data input terminal of a trigger located in a next position;

when any first signal output terminal of the switch control circuit outputs a high-level control signal, other n−1 first signal output terminals all output a low-level control signal, and when any second signal output terminal of the switch control circuit outputs a low-level control signal, other n−1 second signal output terminals all output a high-level control signal.

14. The display device of claim 13, wherein the display device further includes a memory for providing a digital voltage signal; and a digital-to-analog conversion circuit is provided with n voltage signal input terminals and n voltage signal output terminals, the n voltage signal input terminals of the digital-to-analog conversion circuit are all connected to a signal transmission terminal of the memory, the digital-to-analog conversion circuit is for receiving the digital voltage signal output by the memory, converting the digital voltage signal into an analog voltage signal, and outputting the analog voltage signal.

15. The display device of claim 13, wherein the first switch circuit includes n first electronic switches, input terminals of the first electronic switches are the first input terminals of the first switch circuit, controlled terminals of the first electronic switches are the first controlled terminals of the first switch circuit, and output terminals of the first electronic switches are the first output terminals of the first switch circuit.

16. The display device of claim 13, wherein the second switch circuit includes n second electronic switches, input terminals of the second electronic switches are the second input terminals of the second switch circuit, controlled terminals of the second electronic switches are the second controlled terminals of the second switch circuit, and output terminals of the second electronic switches are the second output terminals of the second switch circuit.

17. The display device of claim 16, wherein the reference voltage generating circuit further includes n stabilizing capacitors, one terminal of each of the n stabilizing capacitors is connected to an output terminal of each of the n second electronic switches, and another terminal of each of the n stabilizing capacitors is grounded.

18. The display device of claim 17, wherein when the second electronic switch is turned on, a stabilizing capacitor connected to an output terminal of the turned-on second electronic switch is charged, and the output terminal of the second electronic switch outputs an analog voltage signal;

when the second electronic switch is switched from on state to off state, the stabilizing capacitor connected to the output terminal of the second electronic switch is discharged, and the output terminal of the second electronic switch keeps outputting the analog voltage signal.

19. The display device of claim 13, wherein the digital-to-analog conversion circuit includes n digital-to-analog converters, and output terminals of the digital-to-analog converters are the voltage signal output terminals of the digital-to-analog conversion circuit.

* * * * *